US005686691A

United States Patent [19]

Hamilton et al.

[11] Patent Number: 5,686,691

[45] Date of Patent: Nov. 11, 1997

[54] SLURRY-LOADABLE ELECTRICAL INITIATOR

[75] Inventors: Brian K. Hamilton, Littleton; Kenneth E. Haynes, Parker; Doug R. Kirk, Parker; William J. Blomberg, Parker, all of Colo.

[73] Assignee: OEA, Inc., Aurora, Colo.

[21] Appl. No.: 578,890

[22] Filed: Dec. 22, 1995

[51] Int. Cl.[6] ..... F42B 3/195

[52] U.S. Cl. ..... 102/202.5; 102/202.9; 102/202.14; 102/202.12; 361/247

[58] Field of Search ..... 102/202.1–202.14; 361/247–249; 60/205; 85/20.1

[56] References Cited

U.S. PATENT DOCUMENTS

| | | | |
|---|---|---|---|
| 2,395,104 | 2/1946 | Coleman | 86/31 |
| 3,769,874 | 11/1973 | Willaims et al. | 86/20 C |
| 3,971,320 | 7/1976 | Lee | 102/28 R |
| 4,247,494 | 1/1981 | Carter | 264/3 R |
| 4,685,375 | 8/1987 | Ross et al. | 896/20.15 |
| 4,994,212 | 2/1991 | Vos et al. | 264/3.3 |
| 4,999,063 | 3/1991 | Vos et al. | 149/109.6 |
| 5,019,220 | 5/1991 | Taylor et al. | 264/3.4 |
| 5,034,070 | 7/1991 | Goetz et al. | 149/3 |
| 5,051,143 | 9/1991 | Goetz | 149/3 |
| 5,084,218 | 1/1992 | Vos et al. | 264/3.4 |
| 5,334,025 | 8/1994 | Föhl | 439/188 |

*Primary Examiner*—Michael J. Carone
*Assistant Examiner*—Matthew J. Lattig
*Attorney, Agent, or Firm*—Sheridan Ross P.C.

[57] ABSTRACT

Slurry-loadable electrical initiators are disclosed. In one aspect, a fuel slurry and oxidizer slurry are separately prepared and then mixed (e.g., in a static mixer) into a pyrotechnic material slurry. The pyrotechnic material slurry is loaded into the initiator (e.g., by a positive displacement pump). An ignition assembly which includes a header having at least one electrically conductive pin and a bridgewire between the header and the pin are installed such that the bridgewire appropriately interfaces with the pyrotechnic material of the initiator. In another aspect, another of the electrical connectors for the header is a shell and is joined to the header by a crimped connection or by a welded connection which also interconnects the shell with the charge cup which contains the pyrotechnic material.

40 Claims, 5 Drawing Sheets

SLURRY-LOADABLE ELECTRICAL INITIATOR

FIELD OF THE INVENTION

The present invention generally relates to the field of electrical initiators and, more particularly, to an electrical initiator which is slurry loadable.

BACKGROUND OF THE INVENTION

Electrical initiators are used in a wide variety of applications. Generally, these initiators utilize a pyrotechnic material contained within some type of casing and a bridgewire or the like to ignite the pyrotechnic material at the appropriate time. The bridgewire typically interfaces with the pyrotechnic material and is part of a closed electrical circuit. As such, when a current flows through the bridgewire, the bridgewire heats up and ignites the pyrotechnic material. The output from combustion of the pyrotechnic material may then provide a variety of functions.

Electrical initiators are often used in what might be characterized as high reliability applications, such as in automotive inflatable safety systems. That is, these types of initiators are often part of a system which involves human safety issues in that if there is some type of performance failure, the safety of humans may be at risk. Factors which are critical to the performance of electrical initiators include maintaining a proper interface between the bridgewire and the pyrotechnic material (e.g., such that there is good contact therebetween for ignition) and the structural integrity of the bridgewire such that the electrical ignition circuit remains closed (e.g., to reduce the potential for any breakage of the bridgewire).

In addition to the need for a high "quality control" aspect with electrical initiators used in high reliability applications, there is also a need to maintain adequate safety measures associated with the manufacture of these types of initiators. In some cases the pyrotechnic material used in the electrical initiator may present safety concerns in the manufacture of these types of initiators. For instance, one or more of the individual constituents of the pyrotechnic material may be hazardous for personnel to handle in one or more forms (e.g., certain constituents may be sensitive explosives in powder or granular form). Moreover, the manner in which the pyrotechnic material is prepared may also present personnel safety concerns (e.g., the mixing and handling of one or more constituents in dry form may be hazardous).

SUMMARY OF THE INVENTION

The present invention generally relates to slurry-loadable electrical initiators. One aspect is a method for assembling an electrical initiator which includes loading a pyrotechnic material in slurry form into a charge holder or casing. At least two constituents for the pyrotechnic material are maintained in suspension in the slurry (e.g., a fuel and an oxidizer). An ignition assembly, which includes at least one isolated, electrically conductive pin and a bridgewire in contact therewith, is disposed adjacent the pyrotechnic material and is appropriately interconnected with the charge casing. The ignition assembly typically includes another electrical connection, such as a shell or housing interconnected with the charge casing and/or header (e.g., such that the initiator may have a single, centrally disposed pin), or alternatively a second electrically conductive pin.

Another aspect of the present invention is a method for assembling an electrical initiator which includes providing at least two separate slurries to a mixer. Each of these slurries has at least one constituent for a pyrotechnic material. The slurries are mixed in the mixer to form a pyrotechnic material slurry which is then deposited into a charge holder or casing. An ignition assembly of the above-described type is then disposed adjacent to the pyrotechnic material and is appropriately interconnected with the casing.

In each of the above-described methodologies, the slurry or slurries described therein may be characterized as being relatively viscous (e.g., a viscosity of at least 500,000 centipoise, and typically between about 800,000 centipoise and about 2,000,000 centipoise). This type of viscosity provides a number of desirable functions in relation to slurry-loaded electrical initiators in accordance with principles of the present invention. For instance, the viscosity of the slurry or slurries associated with the present invention contributes to maintaining the noted constituents in preferably substantially uniform suspension within the associated slurry or slurries for a desired period of time. Moreover, the viscosities associated with the slurry-loaded electrical initiators of the present invention allows for achieving a desired variance or maintaining a desired surface configuration of the pyrotechnic material which interfaces with the bridgewire. More specifically, the non-Newtonian rheology, or viscosity, associated with the slurry-loaded electrical initiators of the present invention are such that the slurry "snaps off" or "breaks off" at the end of the slurry load and does not "string" as lower viscosity, more Newtonian fluids do. As such, the magnitude of any raised portion(s) on the surface of the pyrotechnic material is within a range which reduces the potential for breakage of the bridgewire when interfacing with the pyrotechnic material.

The viscosities utilized for the slurry-loaded electrical initiators associated with the present invention provides further advantages. For instance, these types of viscosities also minimize shrinkage of the pyrotechnic material slurry when in the charge holder or casing. Both of the above-described methodologies may further include the step of drying the pyrotechnic material slurry before installing the ignition assembly. Minimizing shrinkage is desirable in relation to maintaining a desirable interface between the bridgewire and the pyrotechnic material.

The viscosity of the slurry-loaded electrical initiators associated with the present invention is also beneficial in relation to weight control of the pyrotechnic material in the charge holder or casing. In this regard, both of the above-described methodologies may further include the step of utilizing a positive displacement pump to load the pyrotechnic material slurry into the charge casing. By controlling the viscosity of the slurry or slurries utilized in the above-noted methodologies and by using positive displacement for loading of the slurry into the charge holder or casing, the accuracy of the amount of pyrotechnic material loaded into the charge casing can be greatly enhanced.

Another aspect of the present invention relates to an electrical initiator which may be slurry loaded in accordance with the above-described methodologies. The initiator includes a charge holder (e.g., generally cup-shaped) with an appropriate pyrotechnic material therein. A header is at least partially disposed in the charge holder and has at least one electrically conductive pin extending therethrough which is isolated from the header by an electrical insulator. The pin provides one electrical connector for the header.

A bridge wire is disposed on the face of the header which interacts with the pyrotechnic material and is attached to the pin and the header to electrically interconnect the same.

Current passing through the pin and bridge wire heats the bridge wire to ignite the pyrotechnic material. In order to complete the electrical circuit and provide another electrical connector for the initiator, an electrically conductive housing or shell is interconnected with the header. This can be provided by a crimped joint which may be affected by providing an annular groove in the header, installing an end of the shell therein (e.g., including a portion of the shell which is folded over onto itself), and crimping the header onto the shell. This provides a desirably "robust" interconnection between the header and the shell connector. This housing or shell can also be a flanged ring which is welded to the header and charge holder simultaneously (e.g., such that all three components are connected by a single, annular or circumferential weld).

DETAILED DESCRIPTION

Figure 1:
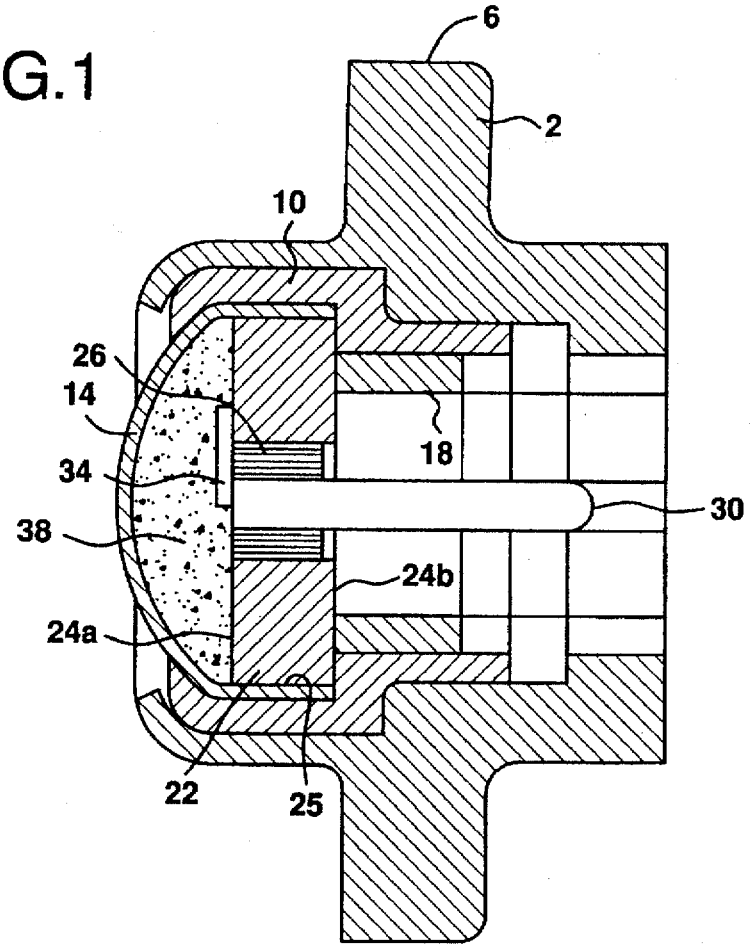
FIG. 1 is a cross-sectional view of one embodiment of a slurry-loaded electrical initiator.

The present invention will be described in relation to the accompanying drawings which assist in illustrating the various pertinent features of the present invention. An electrical initiator 2 is disclosed in FIG. 1 and includes an appropriately configured adapter 6 for mounting the initiator 2 to the desired structure (e.g., an inflator of an automotive inflatable safety system). The initiator 2 includes a metal (e.g., stainless steel) charge holder or cup 14 which contains an appropriate pyrotechnic material 38. A metal header 22 is disposed in the open end of the charge cup 14 and abuts the upper surface of the pyrotechnic material 38. The header 22 also has a substantially planar upper surface **24*a* and lower surface 24*b* and a substantially cylindrically-shaped outer wall 25. The header 22 has a centrally disposed aperture which houses a coaxially, centrally disposed, electrically isolated, conductive pin 30. A glass-to-metal seal 26 is provided between the pin 30 and the header 22**.

The end of the pin 30 is interconnected with a bridgewire 34 which extends from the pin 30, over the glass-to-metal seal 26, and into engagement with the upper surface **24*a* of the header 22. The bridgewire 34 may be welded to each of the pin 30 and the header 22. A metallic ring 18 is welded to the lower surface 24*b* of the header 22 to complete the closed electrical circuit. A nylon insulator sleeve 10 is disposed between the adapter 6 and the charge cup 14/header 22/ring 18 to insulate the adapter 6 therefrom. In operation, an electrical current flows to the pin 30, through the bridgewire 34, across the header 22, and to the ring 18 to heat up the bridgewire 34 and ignite the pyrotechnic material 38**.

There are a number of features which should be noted in relation to the initiator 2. The initiator 2 is suited for high reliability applications which may be defined as human safety-related applications. Moreover, the header 22 is formed from a stamping and coining operation. Furthermore, the ratio of the length of the pyrotechnic material 38 (along the central axis) to the diameter of the pyrotechnic material 38 in the charge cup 14 need not be greater than about 0.5:1, and in many cases may be less than about 0.25:1. Finally, the initiator 2 uses a single, coaxially disposed pin 30 which alleviates the need for the initiator 2 to be in any predetermined "angular" position when installed, as well as the need for any "anti-rotation" structure during manufacturing operations.

Figure 4:
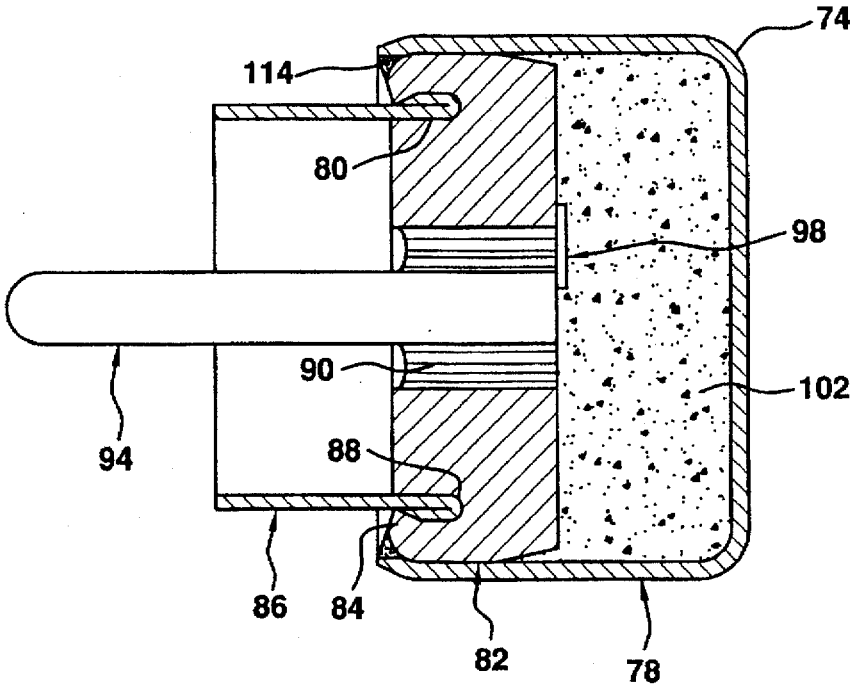
FIG. 4 is a cross-sectional view of another embodiment of an electrical initiator which may be slurry-loaded.
Figure 5:
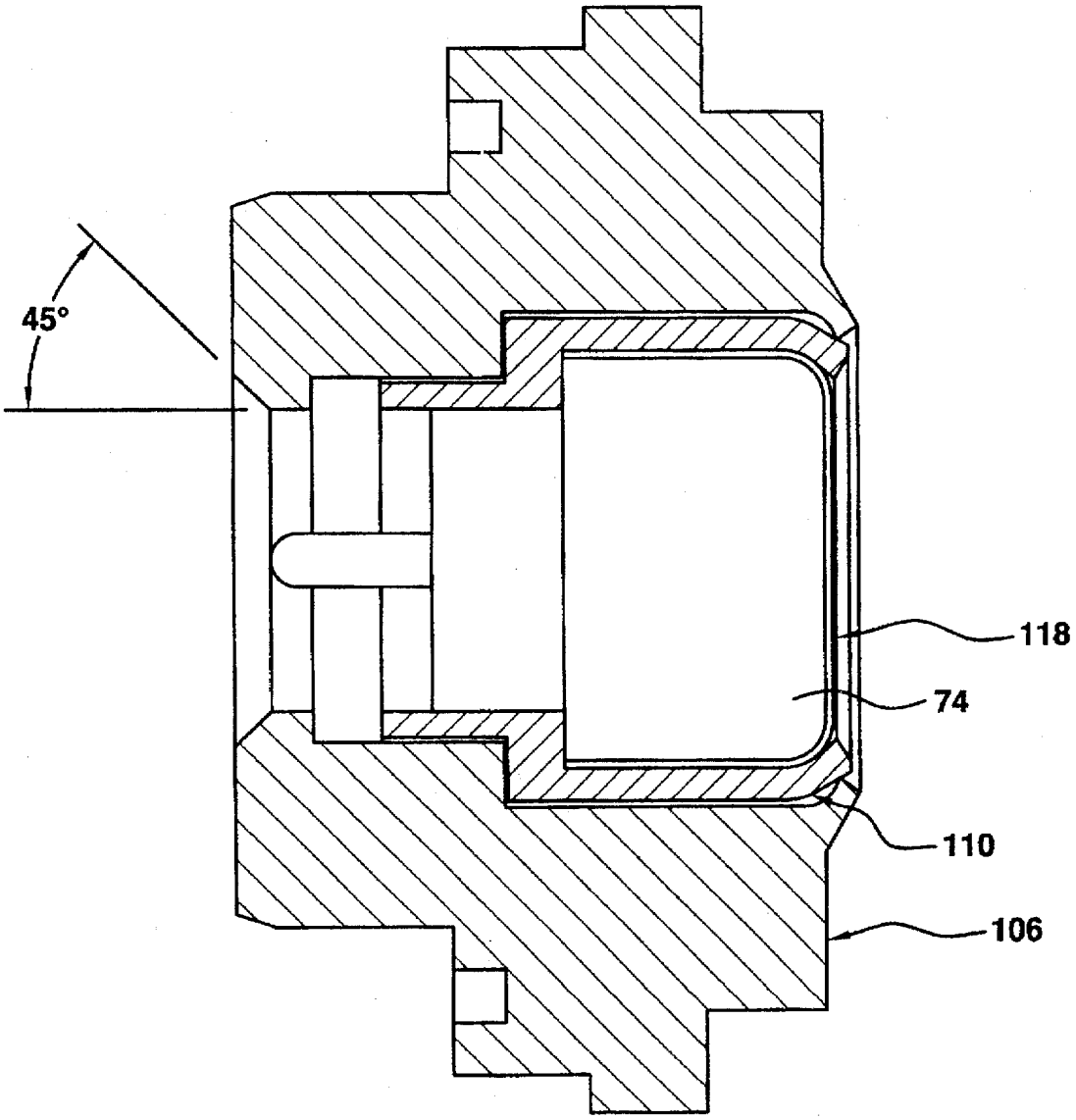
FIG. 5 is a cross-sectional view of an assembly for interfacing the initiator of FIG. 4 with an end-use structure.

Another embodiment of a slurry-loadable electrical initiator is disclosed in FIGS. 4–5. The initiator 74 includes a metal charge holder or cup 78 which contains an appropriate pyrotechnic material 102. A metal header 82 is disposed in the open end of the charge cup 78 and abuts the upper surface of the pyrotechnic material 102. The header 82 has a centrally disposed aperture which houses a coaxially, centrally disposed, electrically isolated and conductive pin 94. A glass-to-metal seal 90 is provided between the pin 94 and the header 82 to provide the isolation between the header 82 and pin 94.

The end of the pin 94 is interconnected with a bridgewire 98 which extends from the pin 94, over the glass-to-metal seal 90, and into engagement with the surface of the header 82 which interfaces with the pyrotechnic material 102. This surface of the header 82 is substantially planar. The bridgewire 98 may be welded to each of the pin 94 and the header 82. Current is therefore able to flow through the pin 94, across the glass-to-metal seal 90 via the bridgewire 98 to increase its temperature to ignite the pyrotechnic material 102, and into the body of the header 92. The electrical circuit is completed by a shell 86 which interfaces with the header 82. The pin 94 and shell 86 provide two electrical connections for the initiator 74, neither of which requires that the initiator 74 being in any particular angular orientation.

The shell 86 is interconnected with the header 82 by a crimped connection. An end portion 88 of the shell 86 is folded over onto itself and is disposed in slot 80 formed in the header 82. With the shell 86 installed in this slot 80, the end portion 84 of the header 82 is crimped inwardly toward the centrally disposed pin 94. The end of the charge cup 78 may be similarly deflected radially inwardly and attached to the header by a circumferential weld 114.

Referring to FIG. 5 where the above-described portion of the initiator 74 is only generally depicted, the initiator 74 may also include an appropriately configured adapter 106 for mounting the initiator 74 to the desired structure (e.g., an inflator of an automotive inflatable safety system). Moreover, a nylon insulator sleeve 110 may be disposed between the adapter 106 and the charge cup 78/header 82 to insulate the adapter 106 therefrom. Furthermore, a cup-shaped sleeve 118 may be disposed over the charge cup 78 to provide an electrical insulation for the end of the charge cup 78.

Figure 6:
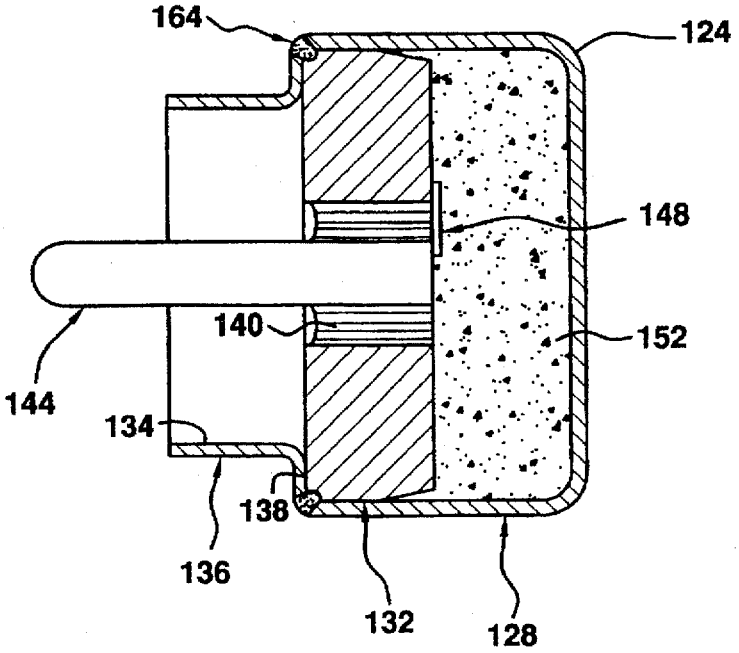
FIG. 6 is a cross-sectional view of another embodiment of an electrical initiator which may be slurry-loaded.
Figure 7:
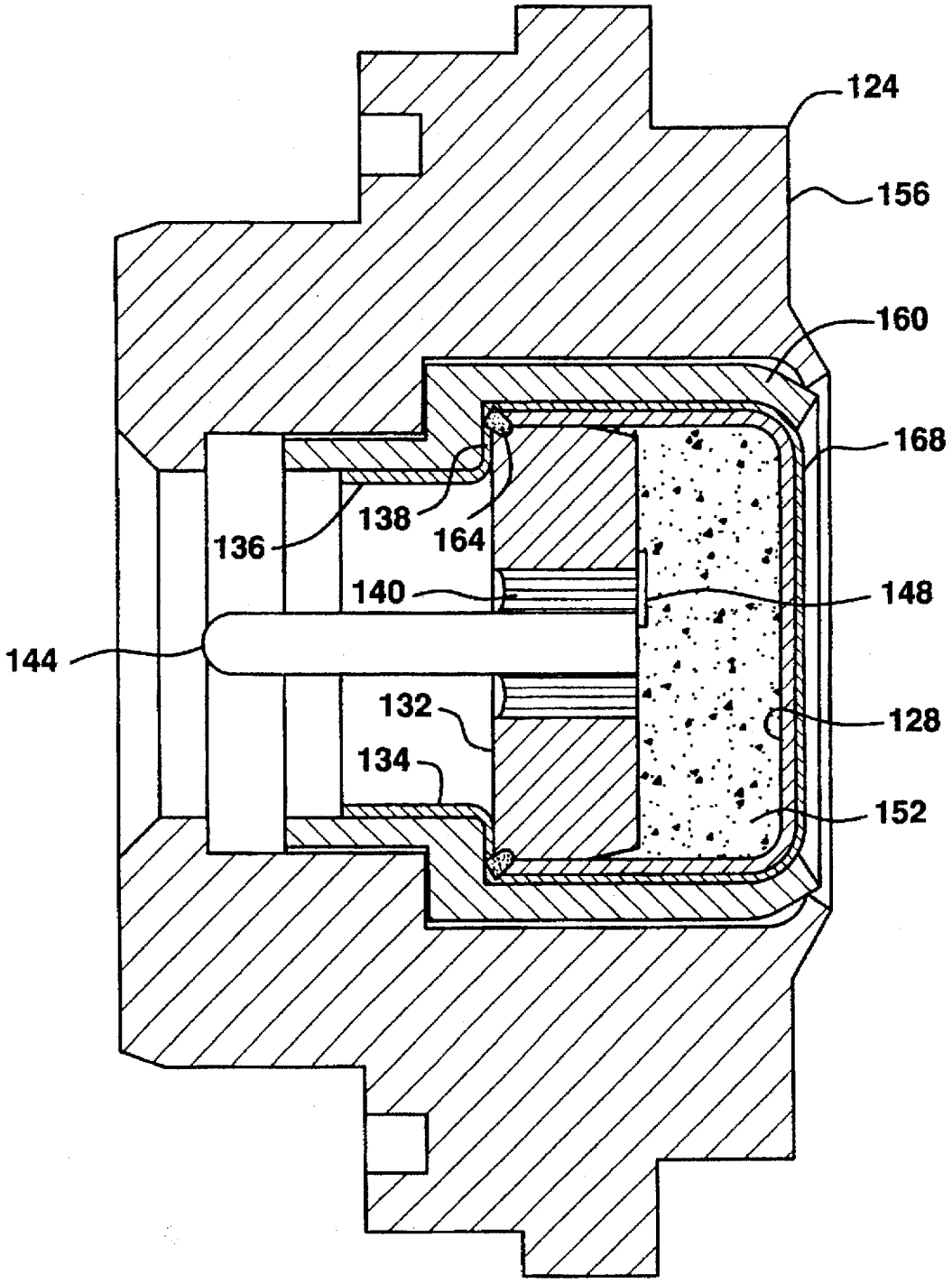
FIG. 7 is a cross-sectional view of an assembly for interfacing the initiator of FIG. 6 with an end-use structure.

Another embodiment of a slurry-loadable electrical initiator is disclosed in FIGS. 6–7. The initiator 124 includes a metal charge holder or cup 128 which contains an appropriate pyrotechnic material 152. A metal header 132 is disposed in the open end of the charge cup 128 and abuts the upper surface of the pyrotechnic material 152. The header 132 has a centrally disposed aperture which houses a coaxially, centrally disposed, electrically isolated and conductive pin 144. A glass-to-metal seal 140 is provided between the pin 144 and the header 132 to provide the isolation between the header 132 and pin 144.

The end of the pin 144 is interconnected with a bridgewire 148 which extends from the pin 144, over the glass-to-metal seal 140, and into engagement with the surface of the header 132 which interfaces with the pyrotechnic material 152. This surface of the header 132 is substantially planar. The bridgewire 148 may be welded to each of the pin 144 and the header 132. Current is therefore able to flow through the pin 144, across the glass-to-metal seal 140 via the bridgewire 148 to increase its temperature to ignite the pyrotechnic material 152, and into the body of the header 132. The electrical circuit is completed by a shell 136 which interfaces with both the header 132 and the charge cup 128. The pin 144 and shell 136 provide two electrical connections for the initiator 124, neither of which requires that the initiator 124 or the corresponding external connector be in any particular angular orientation about the pin centerline.

The shell 136 is interconnected with each of the charge cup 128 and header 132 by an annular or circumferential weld 164. An end portion 138 of the shell 136 is generally perpendicular to its sidewall 134 and may be characterized as a flange. The end portion 138 abuts both the end of the header 132 and the end of the charge cup 128 such that a single weld 164 can be used to interconnect these three elements.

Referring to FIG. 7 where the above-described portion of the initiator 124 is only generally depicted, the initiator 124 may also include an appropriately configured adapter 156 for mounting the initiator 124 to the desired structure (e.g., an inflator of an automotive inflatable safety system). Moreover, a nylon insulator sleeve 160 may be disposed between the adapter 156 and the charge cup 128/header 132 to insulate the adapter 156 therefrom. Furthermore, a cup-shaped sleeve 160 may be disposed over the charge cup 128 to provide an electrical insulation for the end of the charge cup 128.

The pyrotechnic material 38 of the initiator 2 of FIG. 1 may be slurry loaded, as well as the pyrotechnic material 102 of the initiator 74 and the pyrotechnic material 152 of the initiator 124. For convenience, the slurry-loading contemplated by the present invention will be described in relation to the initiator 2. Generally, a fuel slurry and an oxidizer slurry are separately prepared and these slurries are mixed together, preferably at the point of use, into a pyrotechnic material slurry. This pyrotechnic material slurry is then loaded into the charge cup 14. The pyrotechnic material slurry is typically dried to the pyrotechnic material 38 and the assembled ignition assembly (e.g., the header 22 with the bridgewire 34 welded to the pin 30) is installed to appropriately interface the bridgewire 34 and the pyrotechnic material 38. This assembled ignition assembly in fact may be used to compress the pyrotechnic material 38 within the charge cup 14 and to maintain this compression until after the interconnection between the header 22 and cup 14 is established.

Figure 2:
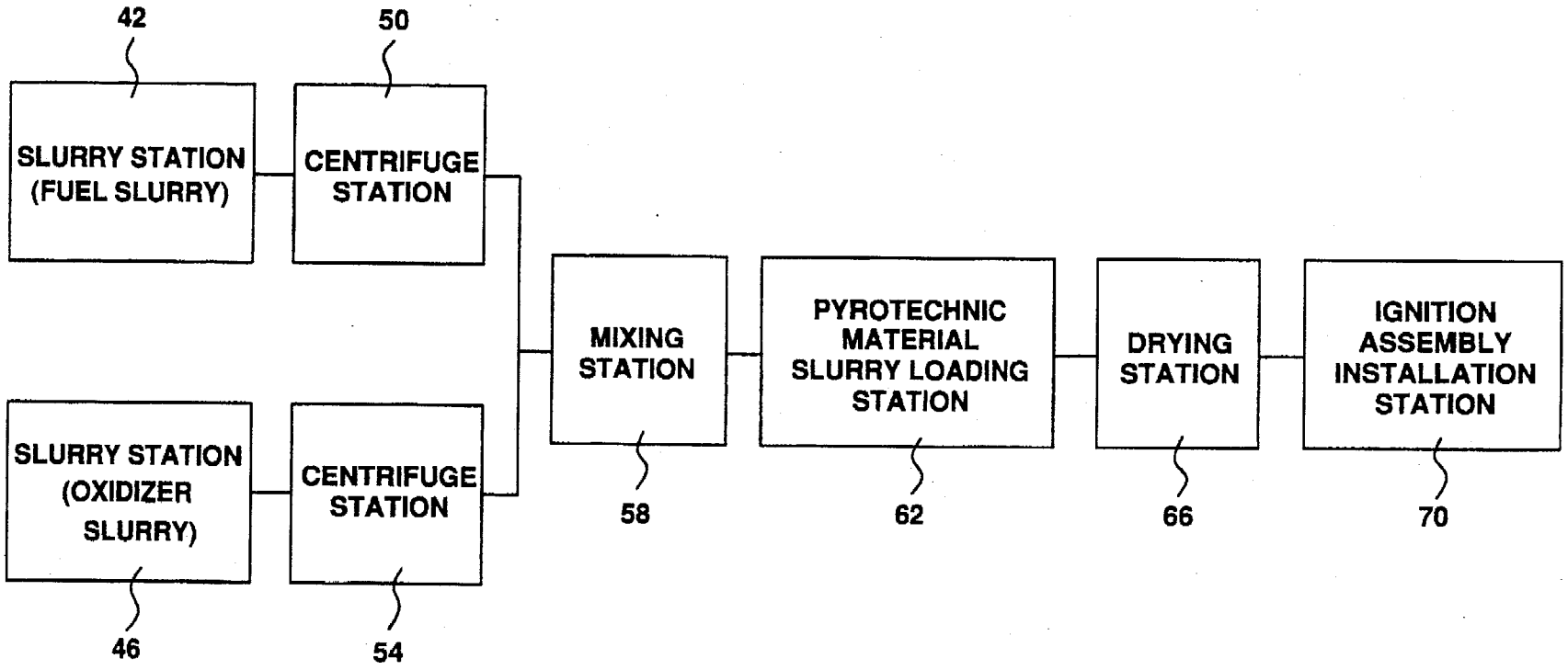
FIG. 2 is a block diagram of a methodology for slurry loading the initiator of FIG. 1.

Referring to FIG. 2, a fuel slurry may be prepared at slurry station 42 and is a simple suspension (e.g., solid fuel(s) suspended in and distributed substantially evenly throughout the fuel slurry). In one embodiment, the fuel slurry is zirconium-based and includes about 100 parts zirconium, about 66.7 parts RDX (hexahydrotrinitrotriazine), about 0.5 parts HPC (hydroxypropyl cellulose), and about 40 parts IPA (isopropyl alcohol). The zirconium is a fuel in the combustion reaction which results from activation of the initiator 2 (for reaction with the potassium perchlorate in the oxidizer slurry to be discussed below) and is suspended in the fuel slurry. A second embodiment is 100 parts zirconium, 0.2 parts HPC, and 20 parts IPA. Other fuels which may be used in the fuel slurry include titanium, metal hydrides, boron, aluminum, halfnium and magnesium. The RDX is also a fuel which provides a high gas output or pressure surge upon activation of the initiator 2 (e.g., an "internal" booster) and is similarly suspended in the fuel slurry. Other boosters which may be used in the fuel slurry include HMX (cyclotetramethylenetetrani-tramine), PETN, nitroguanidine, 5-aminotetrazole and non-explosive organic materials such as cellulosics, polyethylene, carbon, etc.

The HPC is a binder for the pyrotechnic material 38 in the initiator 2, provides a desired viscosity for the fuel slurry, and reduces shrinkage of the pyrotechnic material slurry when drying into the pyrotechnic material 38 as will be discussed in more detail below. Currently, Grade Aqualon MV HPC is being utilized for the present invention. Alternative binders which may be used in the fuel slurry include other cellulosics and other solvent-dispersible viscosity building additives (polymers or high surface area materials such as fumed silica). The IPA is a solvent and typically the HPC is first dissolved in the IPA before the zirconium and RDX are added to the IPA. Other solvents which may be used in fuel slurry include other alcohols, esters, water, and ketones, solvents, and various combinations thereof.

For purposes of the present invention, the fuel (e.g., 2 micron zirconium powder), booster (e.g., 5 micron particle size RDX powder), and binder may be in the form of a powder. The fuel, booster, and binder will each be weighed at the slurry station 42 and appropriately mixed with the solvent. As noted, it may be desirable to first dissolve the HPC in the IPA. Thereafter, the zirconium and RDX may be mixed into the IPA.

The viscosity of the pyrotechnic material slurry, and thus the fuel slurry, is important for one or more aspects associated with slurry loading the initiator 2. For instance, the viscosity of the pyrotechnic material slurry will affect the loading of the pyrotechnic material slurry into the charge cup 14, the distribution of the solids (e.g., fuel(s) and oxidizer(s)) within the pyrotechnic material slurry, the manner in which the pyrotechnic material slurry drys (e.g., the amount of shrinkage and/or cracking), and the degree of the control over the amount of the pyrotechnic material 38 contained within the charge cup 14 when slurry loading. The viscosity of the fuel slurry will typically be greater than about 500,000 centipoise, and more typically be between about 800,000 centipoise and about 2,000,000 centipoise.

Many variables will have an effect on the viscosity of the fuel slurry. Generally, if too much solvent (e.g., IPA) is used in the fuel slurry, the viscosity of the fuel slurry will be lower than desired. This "lower than desired" viscosity will result in an undesired degree of solid separation in the fuel slurry and there will be an undesired degree of shrinkage of the pyrotechnic material when dried in the manner discussed below. If too little solvent is used in the fuel slurry, the fuel slurry will be too viscous and the potential for press drying will exist (pushing the solvent out of the fuel slurry when pumped). Using too much binder (e.g., HPC) has similar effects on the fuel slurry as when too little solvent is used, whereas using too little binder (e.g., HPC) has similar effects on the fuel slurry as when too much solvent is used. The amount of fuel suspended in the fuel slurry will of course also have an effect on the viscosity, but since the amount of fuel in the fuel slurry relates to achieving a desired oxidizer-to-fuel ratio in the pyrotechnic material 38, it is not the primary variable used to control viscosity of the fuel slurry. Typical oxidizer-to-fuel ratios for the pyrotechnic material are between about 70:30 and about 30:70.

Referring back to FIG. 2, an oxidizer slurry may be prepared at slurry station 46. In one embodiment, the oxidizer slurry is potassium perchlorate-based and includes about 80 wt % potassium perchlorate, about 19.6 wt % IPA (isopropyl alcohol), about 0.3 wt % HPC (hydroxypropyl cellulose), and about 0.1 wt % Cab-O-Sil™. The potassium perchlorate is the oxidizer for the combustion reaction which results from activation of the initiator 2 (for reaction with the zirconium and RDX from the fuel slurry). Other oxidizers which may be used in the oxidizer slurry include metal nitrates and chlorates. The HPC and IPA provide the same functions as discussed in relation to the fuel slurry. The Cab-O-Sil™ functions to keep the perchlorates from sticking together and it also affects the viscosity. Therefore, the Cab-O-Sil™ may be characterized as a wetting/viscofying agent. In one embodiment, grade EH-5 Cab-O-Sil™ is used. Appropriate alternatives to the Cab-O-Sil™ include other high surface area materials with hydrogen bonding ability.

For purposes of the present invention, the oxidizer (e.g., 5 micron potassium perchlorate powder), binder (e.g., HPC powder), and wetting/viscofying agent (e.g.,Cab-O-Sil™) may be in the form of a powder. The oxidizer, binder, and wetting/viscofying agent will each be dry weighed at the slurry station 46. As in the case of the fuel slurry, it may be desirable to first dissolve the HPC in the IPA, and to thereafter simultaneously mix in the potassium perchlorate and Cab-O-Sil™. Again, the viscosity of the pyrotechnic material slurry, and thus the oxidizer slurry, affects the various factors discussed above. In one embodiment, the viscosity of the oxidizer slurry will typically be greater than about 500,000 centipoise, and will more typically be between about 800,000 centipoise and about 2,000,000 centipoise.

After the fuel and oxidizer slurries are separately prepared, they may each be centrifuged (e.g., to remove air bubbles therefrom). The fuel slurry may be provided to the centrifuge station 50 and be exposed to centrifugal forces ranging from about 50 "g" to about 500 "g" for a period ranging from about 30 seconds to about 5 minutes, while the oxidizer slurry may be provided to the centrifuge station 54 and be exposed to centrifugal forces ranging from about 50 "g" to about 500 "g" for a time period ranging from about 30 seconds to about 5 minutes.

After undergoing centrifugation and continuing to refer to FIG. 2, the fuel and oxidizer slurries are merged and mixed together at a mixing station 58 to provide a preferably homogeneous pyrotechnic material slurry (e.g., to distribute the solid fuel(s) and oxidizer(s) homogeneously throughout the pyrotechnic material slurry). Preferably, the viscosity of the pyrotechnic material slurry is greater than about 500,000 centipoise, and is more preferably from about 800,000 centipoise to about 2,000,000 centipoise. In one embodiment, the mixing station 58 is a static mixer (e.g., a 10–30 element static mixer). A static mixer can provide a desired degree of homogeneity in the pyrotechnic material slurry, allows for the minimization of the amount of pyrotechnic material slurry which is prepared at any one time (e.g., no more than about 20 grams of pyrotechnic material slurry is mixed at any time during production in one aspect of the present invention), allows the fuel and oxidizer slurries to be continuously provided to the mixing station 58, and allows for the proportioning of the fuel and oxidizer slurries to the mixing station 58 to achieve a desired oxidizer-to-fuel ratio (e.g., between about 1:3 and about 3:1).

Once the pyrotechnic material slurry is prepared, it is directed to a pyrotechnic material slurry loading station 62 where an appropriate amount of the pyrotechnic material slurry is loaded into the initiator 2, more specifically the charge cup 14. In one embodiment, this is provided by utilizing a positive displacement pump (e.g., the Digispense available from IVEK, Inc. North Springfield, Vt.). The use of such a positive displacement pump, in combination with the preferred viscosities of the pyrotechnic material slurry noted above, allows for dispensing accurate amounts of pyrotechnic material slurry into the charge cup 14 of the initiator and to achieve a desirable variance (e.g., less than about 0.5% on volume displacement) in the amount of pyrotechnic material in a plurality of initiators 2 which are slurry loaded in accordance with the present invention. That is, during production the amount of pyrotechnic material 38 in each of a plurality of charge cups 14 will consistently be within a very small range (e.g., less than about 1% variance in the weight of the pyrotechnic material 38 in a plurality of initiators 2).

Figure 3:
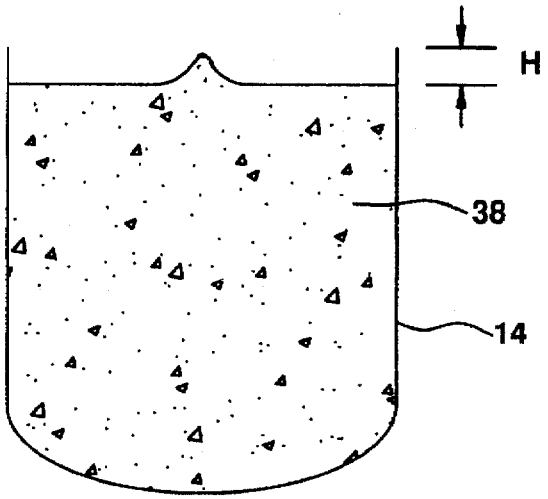
FIG. 3 is a cross-sectional view of a charge cup of an electrical initiator after loading of the pyrotechnic material slurry.

Another important feature of the present invention which relates to the viscosity of the pyrotechnic material slurry and the loading of the pyrotechnic material slurry into the charge cup 14 is the manner in which the loading of the pyrotechnic material slurry terminates. The pyrotechnic material slurry abruptly breaks or snaps off at the end of the loading of the pyrotechnic material slurry into the charge cup 14 in the practice of the present invention such that the height "H" of the nipple illustrated in FIG. 3 is minimized (e.g., preferably no more than about 1 mm). Additionally, the loaded charge cups may be vibrated to level the installed slurry further. A relatively planar upper surface is thus provided for the pyrotechnic material which projects toward and interfaces with the bridgewire 34 on the header 22. This reduces the potential for the bridgewire 34 breaking after the initiator 2 is completely assembled (i.e., when interfacing with the pyrotechnic material 38), as well as the potential for a degree of disengagement between the bridgewire 34 and the pyrotechnic material 38 which would adversely affect ignition of the pyrotechnic material 38.

In some cases, it may be desirable to include a separate booster charge (e.g., pure RDX, HMX, or other secondary explosives or pyrotechnic compositions) in the initiator 2 (e.g., to achieve a certain output), as well in addition to the pyrotechnic material 38. The booster charge could be slurry loaded into the charge cup 14, dried (e.g., at a temperature ranging from about 100° F. to about 160° F. for a time period ranging from about 5 minutes to about 45 minutes, and then packed within the charge cup 14. Before packing, the theoretical density may range from about 60% to about 95%, and after being compacted the theoretical density may range between about 80% and about 97% using an appropriate plunger or even the assembled ignition assembly to do the compacting. The above-described methodology could then be utilized to load the pyrotechnic material slurry into the charge cup 14. Alternatively and more preferably, the booster material could be dry loaded into the charge cup 14 (e.g., 18 micron pure RDX powder) and then packed in the above-described manner. Thereafter, the pyrotechnic material slurry could be loaded into the charge cup 14 in the above-described manner.

After the pyrotechnic material slurry is loaded into the charge cup 14 in the above-described manner, it is provided to a drying station 66 to provide the pyrotechnic material 38. In one embodiment, the charge cup 14 with the pyrotechnic material slurry is dried at a temperature ranging from about 100° F. to about 160° F. for a time period ranging from about 5 minutes to about 45 minutes (e.g. to achieve a moisture content of less than about 0.5%). As will be discussed in more detail below, due to the rheologies associated with the present invention, during this drying of the pyrotechnic material slurry there is little to no shrinkage (e.g., no more than about 2% in diameter and less than about 2% in length).

The viscosity of the pyrotechnic material slurry in the charge cup 14 has an effect on the pyrotechnic material 38 which results from the drying. Initially, the theology of the pyrotechnic material can be selected such that the amount that the pyrotechnic material slurry shrinks during drying is minimized. When a viscosity for the pyrotechnic material slurry is selected within the above-noted range, the amount of shrinkage of the diameter is no more than about 2% and the amount of the shrinkage of the length is no more than about 2%. Moreover, the amount of cracks which occur in the pyrotechnic material slurry as it dries is minimized when using a viscosity in the above-noted range. Cracks could affect the interface between the pyrotechnic material 38 and the bridgewire 34, and thus the ignition of the material 38. Moreover, cracks will affect the burn rate of the material 38 which may be undesired in certain instances.

The assembly of the initiator 2 is completed by installing the assembled ignition assembly at the ignition assembly installation station 70. In one embodiment, the pin 30 is installed in the header 22 with the glass-to-metal seal 26 therebetween, the bridgewire 34 is welded to the pin 30 and to the upper surface **24*a* of the header 22 in the desired position, and the ring 18 is welded to the lower surface 24*b* of the header 22. This assembled ignition assembly is then utilized to compact the dried pyrotechnic material 38 in the charge cup 14 (e.g., to achieve a theoretical density from about 80% to about 97%; using a packing force greater than about 1500 psi). While maintaining compaction of the pyrotechnic material 38 in the charge cup 14 or more specifically while continuing to transmit a force through the ignition assembly to the pyrotechnic material 38, the header 22 is welded to the charge cup 14. Thereafter, the sleeve 10 and adapter 6** may be installed.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A method for assembling an electrical initiator, comprising the steps of:

loading a first slurry into a charge casing, said first slurry comprising first and second constituents in suspension in said first slurry, wherein a first pyrotechnic material comprises said first and second constituents, said charge casing having an open end and a closed end, said loading a first slurry step being through said open end;

drying said first slurry after said loading a first slurry step;

loading an ignition assembly into said charge casing to be substantially adjacent to said first pyrotechnic material, said loading an ignition assembly step being through said open end of said charge casing, said ignition assembly comprising a first electrical conductor and a second electrical conductor which is interconnected with said first electrical conductor and which interfaces with said first pyrotechnic material; and interconnecting said ignition assembly and said charge casing.

2. A method, as claimed in claim 1, wherein:

said loading a first slurry step comprises injecting a fixed volume of said first slurry into said charge casing, said loading step using a positive displacement pump.

3. A method, as claimed in claim 1, wherein:

said loading a first slurry step comprises loading a first slurry comprising a suspension of at least one fuel and at least one oxidizer.

4. A method, as claimed in claim 1, further comprising the steps of:

providing a second slurry of at least said first constituent of said first pyrotechnic material, said first constituent being suspended in said second slurry;

providing a third slurry of at least said second constituent of said first pyrotechnic material, said second constituent being suspended in said third slurry;

mixing said second and third slurries together into said first slurry before said loading a first slurry step.

5. A method, as claimed in claim 4, wherein:

said mixing step comprises providing each of said first and second slurries to a static mixer.

6. A method, as claimed in claim 4, wherein:

said loading a first slurry step comprises using a positive displacement pump.

7. A method, as claimed in claim 4, wherein:

said first constituent comprises zirconium and said second constituent comprises potassium perchlorate.

8. A method, as claimed in claim 4, further comprising the steps of:

maintaining a viscosity of said second slurry between about 500,000 centipoise and about 2,000,000 centipoise during said providing a second slurry step; and maintaining a viscosity of said third slurry between about 500,000 centipoise and about 2,000,000 centipoise during said providing a third slurry step.

9. A method, as claimed in claim 1, wherein:

said mixing step produces no more than about 20 grams of said first slurry at any one time in a continuous process.

10. A method, as claimed in claim 1, wherein:

said drying step comprises exposing said first slurry in said charge casing to a temperature ranging from about 100° F. to about 160° F., and wherein said drying step is performed before said loading an ignition assembly step.

11. A method, as claimed in claim 10, wherein:

said loading an ignition assembly step comprises compressing said first pyrotechnic material after said drying step using at least part of said ignition assembly.

12. A method, as claimed in claim 1, further comprising the step of:

maintaining a viscosity of said first slurry between about 500,000 centipoise and about 2,000,000 centipoise during said loading a first slurry step.

13. A method, as claimed in claim 1, further comprising the step of:

maintaining a variance of less than about 1 millimeter on an upper surface of said first pyrotechnic material when in said charge casing after said loading a first slurry step.

14. A method for assembling an electrical initiator, comprising the steps of:

providing a first slurry comprising a first constituent of a pyrotechnic material to a mixer;

providing a second slurry comprising a second constituent of said pyrotechnic material to said mixer;

mixing said first and second slurries together in said mixer, wherein said mixing step provides a pyrotechnic material slurry;

injecting said pyrotechnic material slurry into a charge casing having an open end and a closed end, said injecting step being through said open end;

drying said pyrotechnic material slurry after said injecting step to provide said pyrotechnic material: and closing said open end of said charge casing with an ignition assembly, said ignition assembly comprising a first electrical conductor and a second electrical conductor which is interconnected with said first electrical conductor and which interfaces with said pyrotechnic material.

15. A method, as claimed in claim 14, wherein:

said first constituent comprises a fuel suspended in said first slurry and said second constituent comprises an oxidizer suspended in said second slurry.

16. A method, as claimed in claim 14, further comprising the steps of:

maintaining a viscosity of said first slurry between about 500,000 centipoise and about 2,000,000 centipoise during said providing a first slurry step; and maintaining a viscosity of said second slurry between about 500,000 centipoise and about 200,000 centipoise during said providing a second slurry step.

17. A method, as claimed in claim 14, further comprising the steps of:

maintaining a viscosity of said first slurry at least at about 500,000 centipoise during said providing a first slurry step; and maintaining a viscosity of said second slurry at least at about 500,000 centipoise during said providing a second slurry step.

18. A method, as claimed in claim 14, wherein:

said first and second constituents are suspended in said first and second slurries, respectively.

19. A method, as claimed in claim 14, wherein:

said mixing step comprises using a static mixer.

20. A method, as claimed in claim 14, wherein:

said mixing step produces no more than about 20 grams of said pyrotechnic material slurry at any one time.

21. A method, as claimed in claim 14, further comprising the step of:

maintaining a viscosity of said pyrotechnic material slurry at least at about 500,000 centipoise during said injecting step.

22. A method, as claimed in claim 14, wherein:

said mixing step comprises suspending said first and second constituents in said pyrotechnic material slurry and distributing said first and second constituents substantially homogeneously throughout said pyrotechnic material slurry.

23. A method, as claimed in claim 14, wherein:

said injecting step comprises injecting a fixed volume of said pyrotechnic material slurry into said charge cases using a positive displacement pump.

24. A method, as claimed in claim 14, wherein:

said drying step comprises drying said pyrotechnic material slurry to define said pyrotechnic material as a solid.

25. A method, as claimed in claim 24, further comprising the step of:

maintaining a variance on an upper surface of said pyrotechnic material of less than about 1 millimeter.

26. A method, as claimed in claim 24, wherein:

said closing step comprises compressing said solid pyrotechnic material after said drying step using at least part of said ignition assembly and interconnecting said ignition assembly with said charge casing during said compressing step.

27. A method for assembling an electrical initiator, comprising the steps of:

loading a first slurry into a charge casing, said first slurry comprising first and second constituents in suspension in said first slurry, wherein a first pyrotechnic material comprises said first and second constituents, said charge casing having an open end and a closed end, said loading a first slurry step being through said open end, wherein prior to said loading a first slurry step said method comprises the steps of:

providing a second slurry of at least said first constituent of said first pyrotechnic material, said first constituent being suspended in said second slurry;

providing a third slurry of at least said second constituent of said first pyrotechnic material, said second constituent being suspended in said third slurry; and mixing said second and third slurries together into said first slurry before said loading a first slurry step, wherein said mixing step comprises providing each of said first and second slurries to a static mixer, and wherein said method further comprises the steps of:

loading an ignition assembly into said charge casing to be substantially adjacent to said first pyrotechnic material, said loading an ignition assembly step being through said open end of said charge casing, said ignition assembly comprising at least one electrically conductive member and a bridge wire interconnected with said at least one electrically conductive member; and interconnecting said ignition assembly and said charge casing.

28. A method for assembling an electrical initiator, comprising the steps of:

loading a first slurry into a charge casing, said first slurry comprising first and second constituents in suspension in said first slurry, wherein a first pyrotechnic material comprises said first and second constituents, said charge casing having an open end and a closed end, said loading a first slurry step being through said open end, wherein prior to said loading a first slurry step said method comprises the steps of:

providing a second slurry of at least said first constituent of said first pyrotechnic material, said first constituent being suspended in said second slurry;

providing a third slurry of at least said second constituent of said first pyrotechnic material, said second constituent being suspended in said third slurry; and mixing said second and third slurries together into said first slurry before said loading a first slurry step, wherein said loading a first slurry step comprises using a positive displacement pump, and wherein said method further comprises the step of:

loading an ignition assembly into said charge casing to be substantially adjacent to said first pyrotechnic material, said loading an ignition assembly step being through said open end of said charge casing, said ignition assembly comprising at least one electrically conductive member and a bridge wire interconnected with said at least one electrically conductive member; and interconnecting said ignition assembly and said charge casing.

29. A method for assembling an electrical initiator, comprising the steps of:

loading a first slurry into a charge casing, said first slurry comprising first and second constituents in suspension in said first slurry, wherein a first pyrotechnic material comprises said first and second constituents, said charge casing having an open end and a closed end, said loading a first slurry step being through said open end, wherein prior to said loading a first slurry step said method comprises the steps of:

providing a second slurry of at least said first constituent of said first pyrotechnic material, said first constituent being suspended in said second slurry;

providing a third slurry of at least said second constituent of said first pyrotechnic material, said second constituent being suspended in said third slurry; and mixing said second and third slurries together into said first slurry before said loading a first slurry step, wherein said first constituent comprises zirconium and said second constituent comprises potassium perchlorate, and wherein said method further comprises the steps of:

loading an ignition assembly into said charge casing to be substantially adjacent to said first pyrotechnic material, said loading an ignition assembly step being through said open end of said charge casing, said ignition assembly comprising at least one electrically conductive member and a bridge wire interconnected with said at least one electrically conductive member; and interconnecting said ignition assembly and said charge casing.

30. A method for assembling an electrical initiator, comprising the steps of:

loading a first slurry into a charge casing, said first slurry comprising first and second constituents in suspension in said first slurry, wherein a first pyrotechnic material comprises said first and second constituents, said charge casing having an open end and a closed end, said loading a first slurry step being through said open end, wherein prior to said loading a first slurry step said method comprises the steps of:

providing a second slurry of at least said first constituent of said first pyrotechnic material, said first constituent being suspended in said second slurry;

maintaining a viscosity of said second slurry between about 500,000 centipoise and about 2,000,000 centipoise during said providing a second slurry step;

providing a third slurry of at least said second constituent of said first pyrotechnic material, said second constituent being suspended in said third slurry;

maintaining a viscosity of said third slurry between about 500,000 centipoise and about 2,000,000 centipoise during said providing a third slurry step; and mixing said second and third slurries together into said first slurry before said loading a first slurry step, wherein said method further comprises the steps of:

loading an ignition assembly into said charge casing to be substantially adjacent to said first pyrotechnic material, said loading an ignition assembly step being through said open end of said charge casing, said ignition assembly comprising at least one electrically conductive member and a bridge wire interconnected with said at least one electrically conductive member; and interconnecting said ignition assembly and said charge casing.

31. A method for assembling an electrical initiator, comprising the steps of:

mixing a first slurry comprising first and second constituents in suspension in said first slurry, wherein a first pyrotechnic material comprises said first and second constituents, wherein said mixing step produces no more than about 20 grams of said first slurry at any one time in a continuous process;

loading said first slurry into a charge casing, said charge casing having an open end and a closed end, said loading a first slurry step being through said open end;

loading an ignition assembly into said charge casing to be substantially adjacent to said first pyrotechnic material, said loading an ignition assembly step being through said open end of said charge casing, said ignition assembly comprising at least one electrically conductive member and a bridge wire interconnected with said at least one electrically conductive member; and interconnecting said ignition assembly and said charge casing.

32. A method for assembling an electrical initiator, comprising the steps of:

loading a first slurry into a charge casing, said first slurry comprising first and second constituents in suspension in said first slurry, wherein a first pyrotechnic material comprises said first and second constituents, said charge casing having an open end and a closed end, said loading a first slurry step being through said open end;

loading an ignition assembly into said charge casing to be substantially adjacent to said first pyrotechnic material, said loading an ignition assembly step being through said open end of said charge casing, said ignition assembly comprising at least one electrically conductive member and a bridge wire interconnected with said at least one electrically conductive member;

drying said first slurry in said charge casing before said loading an ignition assembly step, wherein said loading an ignition assembly step comprises compressing said first pyrotechnic material after said drying step using at least part of said ignition assembly; and interconnecting said ignition assembly and said charge casing.

33. A method for assembling an electrical initiator, comprising the steps of:

loading a first slurry into a charge casing, said first slurry comprising first and second constituents in suspension in said first slurry, wherein a first pyrotechnic material comprises said first and second constituents, said charge casing having an open end and a closed end, said loading a first slurry step being through said open end;

maintaining a viscosity of said first slurry between about 500,000 centipoise and about 2,000,000 centipoise during said loading a first slurry step;

loading an ignition assembly into said charge casing to be substantially adjacent to said first pyrotechnic material, said loading an ignition assembly step being through said open end of said charge casing, said ignition assembly comprising at least one conductive member and a bridge wire interconnected with said at least one electrically conductive member; and interconnecting said ignition assembly and said charge casing.

34. A method for assembling an electrical initiator, comprising the steps of:

loading a first slurry into a charge casing, said first slurry comprising first and second constituents in suspension in said first slurry, wherein a first pyrotechnic material comprises said first and second constituents, said charge casing having an open end and a closed end, said loading a first slurry step being through said open end;

maintaining a variance of less than about 1 millimeter on an upper surface of said first pyrotechnic material when in said charge casing after said loading a first slurry step;

loading an ignition assembly into said charge casing to be substantially adjacent to said first pyrotechnic material, said loading an ignition assembly step being through said open end of said charge casing, said ignition assembly comprising at least one electrically conductive member and a bridge wire interconnected with said at least one electrically conductive member; and interconnecting said ignition assembly and said charge casing.

35. A method for assembling an electrical initiator, comprising the steps of:

providing a first slurry comprising a first constituent of a pyrotechnic material to a mixer;

maintaining a viscosity of said first slurry between about 500,000 centipoise and about 2,000,000 centipoise during said providing a first slurry step;

providing a second slurry comprising a second constituent of a pyrotechnic material to said mixer;

maintaining a viscosity of said second slurry between about 500,000 centipoise and about 2,000,000 centipoise during said providing a second slurry step;

mixing said first and second slurries together in said mixer, wherein said mixing step provides a pyrotechnic material slurry;

injecting said pyrotechnic material slurry into a charge casing having an open end and a closed end, said injecting step being through said open end; and closing said open end of said charge casing with an ignition assembly, said ignition assembly comprising at least one electrically conductive member and a bridge wire interconnected with said at least one member.

36. A method for assembling an electrical initiator, comprising the steps of:

providing a first slurry comprising a first constituent of a pyrotechnic material to a mixer;

maintaining a viscosity of said first slurry at least at about 500,000 centipoise during said providing a first slurry step;

providing a second slurry comprising a second constituent of a pyrotechnic material to said mixer;

maintaining a viscosity of said second slurry at least at about 500,000 centipoise during said providing a second slurry step;

mixing said first and second slurries together in said mixer, wherein said mixing step provides a pyrotechnic material slurry;

injecting said pyrotechnic material slurry into a charge casing having an open end and a closed end, said injecting step being through said open end; and closing said open end of said charge casing with an ignition assembly, said ignition assembly comprising at least one electrically conductive member and a bridge wire interconnected with said at least one member.

37. A method for assembling an electrical initiator, comprising the steps of:

providing a first slurry comprising a first constituent of a pyrotechnic material to a mixer;

providing a second slurry comprising a second constituent of a pyrotechnic material to said mixer;

mixing said first and second slurries together in said mixer, wherein said mixing step provides a pyrotechnic material slurry, and wherein said mixing step produces no more than about 20 grams of said pyrotechnic material slurry at any one time;

injecting said pyrotechnic material slurry into a charge casing having an open end and a closed end, said injecting step being through said open end; and closing said open end of said charge casing with an ignition assembly, said ignition assembly comprising at least one electrically conductive member and a bridge wire interconnected with said at least one member.

38. A method for assembling an electrical initiator, comprising the steps of:

providing a first slurry comprising a first constituent of a pyrotechnic material to a mixer;

providing a second slurry comprising a second constituent of a pyrotechnic material to said mixer;

mixing said first and second slurries together in said mixer, wherein said mixing step provides a pyrotechnic material slurry;

injecting said pyrotechnic material slurry into a charge casing having an open end and a closed end, said injecting step being through said open end;

maintaining a viscosity of said pyrotechnic material slurry at least at about 500,000 centipoise during said injecting step; and closing said open end of said charge casing with an ignition assembly, said ignition assembly comprising at least one electrically conductive member and a bridge wire interconnected with said at least one member.

39. A method for assembling an electrical initiator, comprising the steps of:

providing a first slurry comprising a first constituent of a pyrotechnic material to a mixer;

providing a second slurry comprising a second constituent of a pyrotechnic material to said mixer;

mixing said first and second slurries together in said mixer, wherein said mixing step provides a a pyrotechnic material slurry;

injecting said pyrotechnic material slurry into a charge casing having an open end and a closed end, said injecting step being through said open end;

closing said open end of said charge casing with an ignition assembly, said ignition assembly comprising at least one electrically conductive member and a bridge wire interconnected with said at least one member;

drying said pyrotechnic material slurry in said charge casing before said closing step, said drying step providing a solid pyrotechnic material; and maintaining a variance on an upper surface of said pyrotechnic material of less than about 1 millimeter.

40. A method for assembling an electrical initiator, comprising the steps of:

providing a first slurry comprising a first constituent of a pyrotechnic material to a mixer;

providing a second slurry comprising a second constituent of a pyrotechnic material to said mixer;

mixing said first and second slurries together in said mixer, wherein said mixing step provides a pyrotechnic material slurry;

injecting said pyrotechnic material slurry into a charge casing having an open end and a closed end, said injecting step being through said open end;

closing said open end of said charge casing with an ignition assembly, said ignition assembly comprising at least one electrically conductive member and a bridge wire interconnected with said at least one member; and drying said pyrotechnic material slurry in said charge casing before said closing step, said drying step providing a solid pyrotechnic material, wherein said closing step comprises compressing said solid pyrotechnic material after said drying step using at least part of said ignition assembly and interconnecting said ignition assembly with said charge casing during said compressing step.

* * * * *